US007612271B1

(12) United States Patent
Davis et al.

(10) Patent No.: US 7,612,271 B1
(45) Date of Patent: Nov. 3, 2009

(54) TUBULAR BRACING FOR A MUSICAL INSTRUMENT

(76) Inventors: Stephen Davis, 18 Hansel Rd., Newtown, PA (US) 18940; C. Malcolm Bash, 21 Washington Dr., Cranbury, NJ (US) 08512

( * ) Notice: Subject to any disclaimer, the term of this patent is extended or adjusted under 35 U.S.C. 154(b) by 0 days.

(21) Appl. No.: 11/904,690

(22) Filed: Oct. 1, 2007

Related U.S. Application Data

(60) Provisional application No. 60/848,036, filed on Sep. 29, 2006.

(51) Int. Cl.
*G10D 1/08* (2006.01)

(52) U.S. Cl. ..... 84/267; 84/291

(58) Field of Classification Search ..... 84/267, 84/290, 291, 467
See application file for complete search history.

(56) References Cited

U.S. PATENT DOCUMENTS

| | | | | |
|---|---|---|---|---|
| 72,591 | A | 12/1867 | Bini | |
| 1,768,261 | A | 6/1930 | Larson | |
| 1,889,408 | A | 11/1932 | Larson | |
| 3,474,697 | A | 10/1969 | Kaman | 84/267 |
| 3,656,395 | A | 4/1972 | Kaman | 84/267 |
| 3,685,385 | A | 8/1972 | Rendell | 84/267 |
| 3,892,159 | A | 7/1975 | Houtsma | 84/307 |
| 3,974,730 | A | 8/1976 | Adams, Jr. | 84/291 |
| 4,079,654 | A | 3/1978 | Kasha | 84/291 |
| 4,084,475 | A | 4/1978 | Horowitz | 84/291 |
| 4,178,827 | A | 12/1979 | Mallory | 84/291 |
| 4,388,852 | A * | 6/1983 | Cramer | 84/284 |
| 5,461,958 | A | 10/1995 | Dresdner et al. | 84/267 |
| 5,469,770 | A | 11/1995 | Taylor | 84/291 |
| 5,952,592 | A | 9/1999 | Teel | 84/291 |
| 6,166,308 | A | 12/2000 | Lam | 84/291 |
| 6,294,718 | B1 * | 9/2001 | Saunders et al. | 84/291 |
| 6,627,803 | B1 | 9/2003 | Stephens | 84/291 |
| 6,943,283 | B2 | 9/2005 | McPherson | 84/291 |
| 2003/0154843 | A1 * | 8/2003 | McPherson | 84/291 |
| 2004/0231487 | A1 | 11/2004 | Jagmin | |

* cited by examiner

*Primary Examiner*—Kimberly R Lockett
(74) *Attorney, Agent, or Firm*—LaMorte & Associates P.C.

(57) ABSTRACT

A tubular bracing assembly for a string instrument and the resulting string instrument. Resin reinforced fibers are shaped into the form of a tubular structure. The tubular structure decreases the weight and increases the stiffness of the structure. The result is a bracing system that has very light weight and varied stiffness properties to achieve desirable acoustic performance from the hollow body of an acoustic instrument.

18 Claims, 3 Drawing Sheets

TUBULAR BRACING FOR A MUSICAL INSTRUMENT

RELATED APPLICATIONS

This application claims priority of Provisional patent Application No. 60/848,036, entitled Tubular Bracing For A Musical Instrument, filed Sep. 29, 2006.

BACKGROUND OF THE INVENTION

1. Field of the Invention

In general, the present invention relates to stringed musical instruments. More particularly, the present invention relates to the bracing structures used to internally reinforce stringed musical instruments.

2. Prior Art Description

Many acoustic stringed musical instruments, such as guitars, violins, cellos, and the like, rely upon the body of the instrument to resonate and amplify the vibrations of the instrument's strings. Such wooden instruments typically are constructed with a hollow body that is covered by a soundboard. The soundboard faces the strings of the instrument and contains openings through which sound energy can pass into and out of the hollow body.

The hollow body typically is configured to have a backboard and side walls. The sound board is attached to the top of the side walls opposite the backboard. Various types of bracings are used to interconnect the backboard, side walls and soundboard at various junctions.

The soundboard is the part of a wooden instrument that resonates most in response to the vibrations of the instrument's strings. The soundboard needs to be as thin as possible to react to the string vibrations and create sound. However, the soundboard cannot be made so thin as to be weak. On a string instrument, the strings are strung across a bridge. The bridge presses against the soundboard of the instrument. The strings are under tension. This applies a downward force to the soundboard that must be borne by the soundboard.

In order to provide a soundboard that is both thin and strong, bracing is used to reinforce the soundboard. The traditional material for bracing is wood. Wood is used for its warm, tonal properties. However, wood has many disadvantages. Wood, being a natural material, can vary considerably within the same species. Wood may differ in strength, rigidity and tonal quality from piece-to-piece. Furthermore, wood is influenced by changes in temperature and humidity that causes the wood to expand and contract. In an instrument, the resulting dimensional changes affect the tone of the instrument.

There have been numerous designs using wood bracing to support the soundboard. The arrangement and dimension of the bracing can vary to produce different performance characteristics.

One of the earliest examples of wood bracing for soundboards is U.S. Pat. No. 72,591 to Joseph Bini, entitled Bracing For Guitar Sounding Boards, which describes a wood bracing for a soundboard which is in an "X" orientation, where the main bracing crosses over itself near the sound hole. Other bracing configurations are exemplified by U.S. Pat. No. 1,768,261 to Larson, entitled Guitar; U.S. Pat. No. 1,889,408 to Larson; entitled fretted Stringed Musical Instrument; U.S. Pat. No. 3,474,697 to Kaman, entitled Guitar Construction; U.S. Pat. No. 3,685,385 to Rendell, entitled Guitar; U.S. Pat. No. 3,892,159 to Houtsma, entitled Soundboard Bridge Configuration For Acoustic Guitar; U.S. Pat. No. 5,461,958 to Dresdner, entitled Acoustic Guitar Assembly; U.S. Pat. No. 5,952,592 to Teel, entitled Acoustic Guitar Assembly; and U.S. Pat. No. 6,166,308 to Lam, entitled Guitar Sound Board Assembly.

U.S. Pat. No. 3,656,395 to Kaman, entitled Guitar Construction, describes a wood brace arrangement where the main braces are oriented at an angle to the longitudinal axis of the soundboard, with a plurality of smaller braces oriented in a longitudinal manner.

U.S. Pat. No. 4,079,654 to Kasha, entitled Bracing Structure For Stringed Musical Instrument, describes a wood brace arrangement with a torsion bar positioned under the bridge to support the various loads and relieve other portions of the soundboard.

U.S. Pat. No. 3,974,730 to Adams, entitled Guitar Strut Assembly, describes an "X" brace arrangement with a pair of struts connecting the soundboard bracing with the backboard bracing.

U.S. Pat. No. 4,084,475 to Horowitz, entitled Guitar Construction, describes bracing arranged in a fan pattern from the sound hole to the heel end of the soundboard.

U.S. Pat. No. 4,178,827 to Mallory, entitled Stringed Instrument Construction, describes a wood brace arrangement with long main braces oriented longitudinally and positioned on either side of the sound hole.

U.S. Pat. No. 5,469,770 to Taylor, entitled Distributed Load Soundboard System, describes a brace arrangement where the braces intersect at a point below the bridge area.

U.S. Pat. No. 6,627,803 to Stephens, entitled Musical Instrument Brace, describes a wood brace design with holes in the brace to reduce the weight.

U.S. Pat. No. 6,943,283 to McPherson, entitled Bracing System For Stringed Instrument, describes a wood brace design with tunnels and valleys to create a 3D bracing system.

U.S. Patent Application Pub. No. US2005/0150346 to Wyman, entitled Stringed Musical Instrument, describes a laminated wood brace which is scalloped to provide less contact with the soundboard.

U.S. Pub. No. US2004/0231487 to Jagmin, entitled Acoustic Guitar Assembly, describes a bracing system made from graphite rods, preferably wrapped with spruce wood, which connect the neck to the soundboard.

All of the prior art bracing systems listed above use braces which are solid, and mostly constructed of wood. A disadvantage of solid braces is that they are heavy, and therefore reduce the vibrational response of the hollow body and soundboard. Furthermore, the production of wood bracing is a laborious process because wood must be cut into the desired shape while maintaining a consistent environment for temperature and humidity. Wood is also limited in terms of weight and stiffness. In general, a stiffer wood is heavier than a flexible wood. It is therefore difficult to make bracing from wood that is both stiff and lightweight.

A good bracing system for a string instrument is one that can offer a range of stiffness with the lightest weight possible. A good bracing system should also be versatile and easy to attach to the instrument.

A need therefore exists for a tubular bracing system that is lightweight, has good acoustic response, and can provide a range of stiffness to satisfy a multitude of needs. This need is met by the present invention as described and claimed below.

SUMMARY OF THE INVENTION

The present invention is a tubular brace system for the resonance chamber of a string instrument and the string instrument that utilizes such a brace system. Acoustical string instruments have hollow resonance chambers which react to the vibrations of the strings and create the tone of the instrument. It is desirable that the components of the resonance chamber, e.g., the soundboard, backboard, and side wall be as light as possible, because it requires less energy to vibrate a lighter mass. A good bracing system should be as light as possible, yet provide enough support to the soundboard to resist deformation from the tension the strings.

The bracing system of the present invention is tubular in its construction. The tubular bracing elements can be formed in a variety of geometries to achieve different rigidities. The tubular bracing elements are attached to the soundboard, the side walls and any other part of the resonance chamber that needs reinforcement. Since the bracing elements are tubular, they are both strong and light. Furthermore, the tubular shape of the bracing elements can add to the resonance characteristics of the resonance chamber.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be incorporated into many instruments, such as a violin, cello, base or banjo, the present invention is particularly well suited for use in an acoustic guitar. Accordingly, the present invention will be described embodied within a guitar in order to set forth one of the best modes contemplated for the invention. However, it will be understood that the choice of a guitar is merely exemplary and should not be considered a limitation on the application of the present invention to other instruments.

Figure 1:
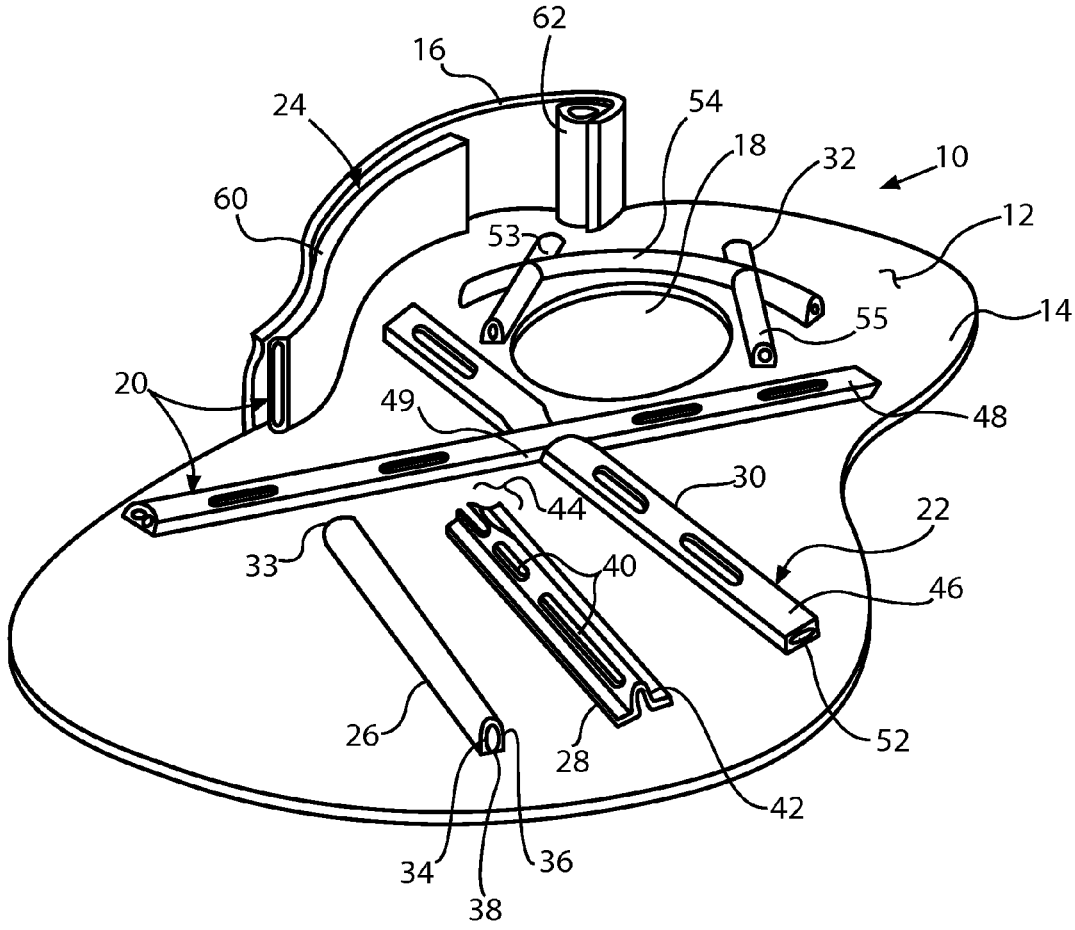
FIG. 1 is a fragmented perspective view of the resonance chamber of an acoustic guitar.

It will be understood that many string instruments have a resonance chamber. The purpose of the resonance chamber is to amplify the vibrations of the strings and to add complimentary resonance to the sound of the strings. Referring to FIG. 1, a portion of the resonance chamber 12 of a guitar 10 is shown. The portion of the resonance chamber 12 that is shown includes the underside of the guitar soundboard 14 and a segment of a side wall 16. The guitar soundboard 14 has a traditional construction, having an hourglass shape and a central open sound hole 18.

A variety of tubular bracing 20 is illustrated. The purpose of the tubular bracing 20 is to selectively reinforce the soundboard 14 and/or the side wall 16. It will be understood that all the tubular bracing 20 in the exemplary embodiment need not be used. The variety of tubular bracing 20 is shown merely to illustrate some of the many forms that the present invention can take.

In FIG. 1, the tubular bracing 20 includes both soundboard bracing 22 and side wall bracing 24. The soundboard bracing 22 is used to selectively reinforce the structure of the soundboard 14. Likewise, the side wall bracing 24 is used to selectively reinforce the side walls 16 and help in the joining of the side walls 16 to both the soundboard 14 and an opposite backboard (not shown).

Each component of the tubular bracing 20 defines at least one internal channel. Due to the tubular construction of the tubular bracing 20, the tubular bracing 20 is both lightweight and stiff. The various components of the tubular bracing 20 can be extruded tubes of strong lightweight alloy metals, such as aluminum or titanium. However, in the preferred embodiment, the tubular bracing 20 is made of tubes of composite material, as is later described in more detail.

The advantages of the tubular bracing 20 are numerous. First of all, a significant weight reduction is possible. Compared to a typical wood bracing, a composite tubular brace with similar stiffness properties is approximately 12% of the weight of a wood brace if made from carbon fiber/epoxy, and approximately 63% of the weight of a wood brace if made from fiberglass/epoxy.

The tubular bracing 20 can also have acoustic benefits. As sound waves are generated inside the resonance chamber 12, these sound waves can travel into the tubular bracing 20, creating desirable secondary tones. The secondary tones can be adjusted by varying the size, shape and construction of the tubular bracing 20.

Conversely, the tubular bracing 20 can have an isolated interior that prevents any sound waves from traveling inside the tubular bracing 20. Another alternative is to have foam inside the tubular bracing to partially attenuate any undesirable frequencies.

As was previously stated, the soundboard 14 is reinforced by the soundboard bracing 22. In the shown embodiment, three exemplary types of soundboard bracing 22 are shown. The soundboard bracing 22 includes two solitary element braces 26, 28, a dual element brace 30 and a multi-element brace 32.

In the exemplary embodiment of FIG. 1, the first solitary element brace 26 has a first end 33 a second end 34 and a closed tubular structure that extends between the two ends 33, 34. That is, the first solitary element brace 26 has a continuous cross-sectional wall 36 that extends from the first end 33 to the second end 34. The first solitary element brace 26 contains at least one flat side 38. The flat side 38 of the first solitary element brace 26 is affixed to the underside of the soundboard 14 with either adhesive, and/or mechanical fasteners.

The rigidity of the first solitary element brace 26 is determined primarily by its length, width, height and the thickness of its wall 36. It will therefore be understood that the length, width, height and wall thickness of the first solitary element brace 26 can be altered to match the reinforcement needs for a particular area of the soundboard 14 in a particular instrument. It will further be understood that if the first solitary element brace 26 is made from composite material, the resin used in the composite material and the fiber material used in the composite material can be altered to either increase or decease rigidity.

The second solitary element brace 28 is used as an example of an open tubular structure. That is, the second solitary element brace 28 has a cross-sectional peripheral wall shape that is not continuous. The second solitary brace 28 has flat areas that bond to the soundboard 14. In doing so, the soundboard forms a wall and effectively creates a tubular structure in conjunction with the second solitary element 28 Open tubular structures are preferred for braces made of metal, being that such shapes are easily extruded. Again, although the second solitary element brace 28 is not a closed tube, it has a length, width, height and wall thickness that can be varied to alter its rigidity.

In the shown illustration, the second solitary element brace 28 contains engineered openings 40 formed along its length. The engineered openings 40 are formed in the walls 42 of the second solitary element brace 28. The engineered openings 40 can have two purposes. First, they can be designed to reduce weight from the second solitary brace element 28 without significantly reducing the rigidity. Secondly, the engineered openings 40 can be made large enough to selectively alter the rigidity of the second solitary element brace 28 in specific areas. A side benefit of the engineered openings 42 is that they allow sound energy and air to pass through the structure of the brace.

In addition to the engineered openings 40, the solitary element brace 28 may have reduced sections 44 where the width, height and/or wall thickness of the solitary brace element 28 is reduced. In the reduced sections 44, the solitary brace element 28 is less stiff and/or fails to contact the soundboard 14. This enables the rigidity of the solitary brace element 28 to be further customized to the needs of a specific instrument.

The dual element brace 30 is a brace having two brace elements 46, 48 that intersect at some point. The two brace elements 46, 48 can be integrally formed together or may just be two single brace elements laid in a crisscrossing pattern. In the embodiment of FIG. 1, the dual element brace 30 is configured in an X-pattern and is comprised of two crisscrossing single brace elements 46, 48. The two single brace elements 46, 48 each have opposing lap reliefs 49 that enable the two brace elements 46, 48 to crisscross while remaining flush against the soundboard 14.

Since the dual element brace 30 is comprised of two intersecting single brace elements 46, 48, it will be understood that the single brace elements 46, 48 can have any of the features, such as closed tube or open tube structures, engineered openings 40 and reduced sections 44, that were previously described as options for the solitary element braces 26, 28.

In the exemplary embodiment of FIG. 1, it can be seen that the cross-sectional profile of each of the intersecting brace elements 46, 48 is different from those previously described. The brace elements 46, 48 have an overall tubular shape that defines an open interior 52.

In FIG. 1, a multi-element brace 32 is also shown. The multi-element brace 32 includes at least three brace elements 53, 54, 55 that intersect at one or more points. In the shown embodiment, the multi-element brace 32 has a general A-shape. The multi-element brace 32 can be made from three or more independent brace elements. However, in the shown embodiment, the multi-element brace 32 is a single integral unit that cannot be nondestructively divided. By making the various brace elements 53, 54, 55 of the multi-element brace 32 a single unit, the various intersecting brace elements 53, 54, 55 create a rigid framework where the various intersecting brace elements 53, 54, 55 reinforce each other.

Although not shown, it will be understood that features, such as engineered openings and reduced sections can be incorporated into the structure of the multi-element brace 32 in order to vary the rigidity of the multi-element brace 32 to meet the needs of a section of soundboard in a particular instrument.

In the embodiment of FIG. 1, a running brace 60 and a corner brace 62 are illustrated. The running brace 60 and the corner brace 62 are used to both reinforce the side wall 16 of the resonance chamber 12 as well as provide attachment points where the soundboard 14 and backboard (not shown) can attach to the side wall.

Traditionally side wall brackets were a wood part that had been kerfed, or cut, to allow it to bend to the desired shape. Such wooden features can be replaced by the running brace 60. The running brace 60 conforms to the curvature of the side wall 16. The running brace 60 can be continuous around the interior of the side wall 16 or may be present only in sections that require reinforcement. The rigidity of the running brace 60 can be modified by varying the dimensions and materials of the running brace 60. Rigidity can be further adjusted by the use of engineered openings and other modifications of the type previously described with the second solitary element brace 28.

The corner brace 62 shown in FIG. 1 is a single element brace that is placed in a vertical orientation. The corner brace 62 is used to reinforce the side wall 16 at corners where the neck of the instrument connects to the side wall 16. The rigidity of the corner bracket 62 can be adjusted in the same manner as has been described for the second solitary element brace 28 present on the on the soundboard 14.

Figure 2:
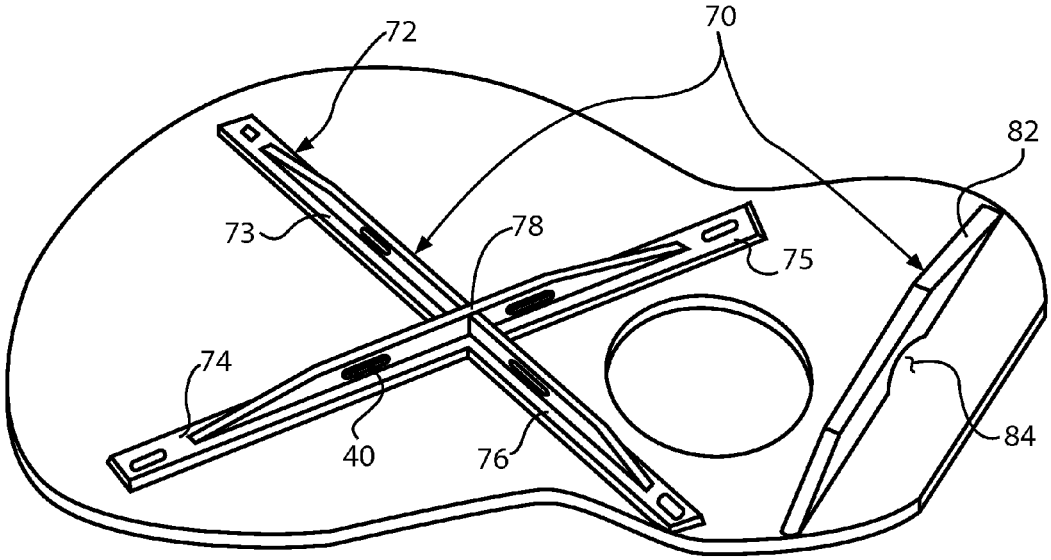
FIG. 2 is a fragmented perspective view of a soundboard of a guitar reinforced by alternate embodiments of tubular bracing.

Referring to FIG. 2, an alternate set of tubular bracing 70 is shown reinforcing the soundboard 14 of a guitar. In this embodiment, a dual element brace 72 is shown that is integrally formed as a single piece. The dual element brace 72 is generally X-shaped having four linear brace elements 73, 74, 75, 76 that intersect at a common point 78. Each of the linear brace elements 73, 74, 75, 76 has cross sectional dimensions that vary along their length to provide different performance characteristics. In the shown embodiment, each of the linear brace elements 73, 74, 75, 76 starts out thin and flexible and increases in both size and rigidity as the linear brace elements 73, 74, 75, 76 converge to the common point 78.

In the thin regions of the linear brace elements 73, 74, 75, 76, the linear brace elements may be solid. However, as the linear brace elements 73, 74, 75, 76 increase in dimensions, the linear brace elements become hollow to minimize weight. It will therefore be understood that the tubular bracing 70 need not be hollow from end to end. Rather, the tubular bracing 70 need only define an internal channel as some point between its two ends.

As with previous examples of tubular bracing, the tubular bracing 70 exemplified in FIG. 2 can contain engineered openings 40 and recesses that are designed to decrease weight, selectively alter rigidity and/or add tonal properties to sound energy resonating in the resonance chamber of the instrument.

In FIG. 2, the shown tubular bracing 70 also includes a solitary brace 82. A relief 84 is formed in the solitary brace 82 so show that no element of the tubular bracing 70 needs to be in contact with the instrument along its entire length. By providing reliefs of different sizes, areas of the soundboard that resonate vigorously can be supported without being acoustically dampened.

Additionally, it should be noted that the exemplary solitary element brace 82 in FIG. 2 has closed ends and no side openings. The interior of the solitary element brace 82 is therefore isolated from the environment of the resonance chamber. In this manner, the bracing does not add to the resonance acoustics within the instrument.

Figure 3:
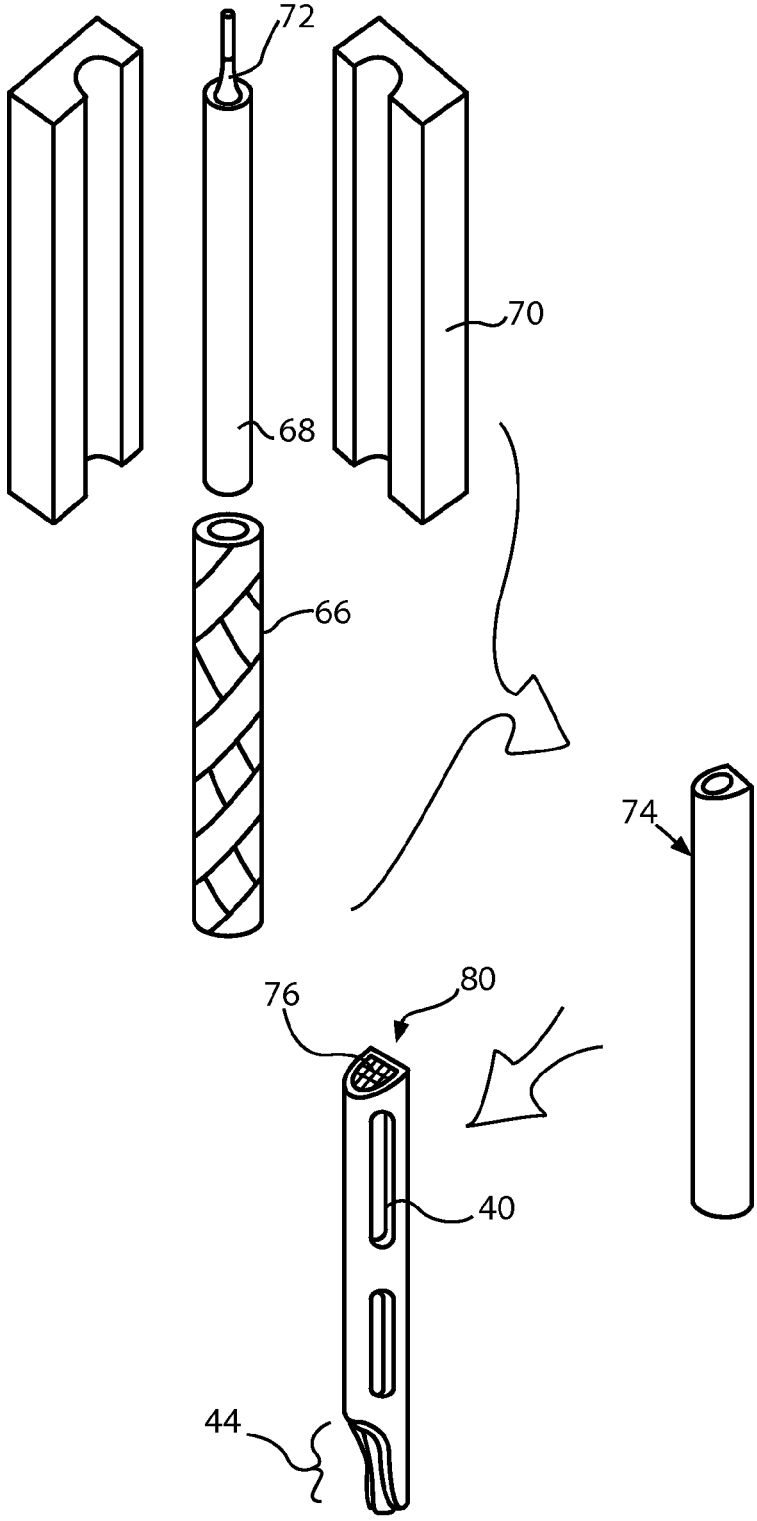
FIG. 3 is a schematic illustrating an exemplary method of manufacture.

Referring to FIG. 3, an exemplary method of forming tubular bracing such as that in FIG. 1 or FIG. 2 is described. Although the method can be used to create any of the tubular bracing previously described, a simple brace elements 80 is illustrated for sake of simplicity.

In FIG. 3, it can be seen that a prepeg tube preform 66 is provided that is to be molded into a desired shape. The prepeg tube preform 66 is preferably fabricated from raw material in sheet form known as "prepreg" which has reinforcing fibers impregnated with a thermoset resin such as epoxy. The resin is in a "B Stage" liquid form which can be readily cured with the application of heat and pressure. The fibers can be woven like a fabric, or may be unidirectional. A variety of high performance reinforcement fibers can be selected, such as carbon, aramid, fiberglass and the like. The prepreg material is in sheet form and is cut at various strip widths, lengths, and fiber angles to prepare what is known as a "lay-up". The lay-up is a combination of these strips which are overlapped and rolled up over a mandrel to form the prepreg tube preform 66. Another option is to braid the filaments into the prepreg tube preform 66. Yet another option is to use woven prepreg fabric and roll it into the prepreg tube preform 66.

A thin walled bladder 68 is placed into the interior of the prepreg tube preform 66. The bladder 68 is inflated to expand the prepreg tube preform 66 during the forming process. The prepreg tube preform 66 is then placed into a mold 70 of a desired shape. Air fittings 72 are attached to the ends of the bladders 68. The mold 70 is pressed closed in a heated platen press, and air pressure is applied to the bladders 68 which expand the prepreg tube preform 66. As the temperature rises in the mold 70, the viscosity of the epoxy resin decreases and the bladder 68 expands to apply consolidation pressure to the prepreg tube preform 66. Eventually the epoxy resin is cross-linked and cured. The mold 70 is then opened and the part is removed from the mold. The bladder 68 is removed and a rough tubular brace 74 is formed. The rough tubular brace 74 is cut to length and cleaned of flashing.

The rough tubular brace 74 is then tested for rigidity. Variables in epoxy, fibers and fiber direction will cause each piece to vary slightly in rigidity.

Assuming the support profile for a particular instrument is known, the rough tubular brace 74 is machined to match that profile. Engineered openings 40 and reduced sections 44 may be cut into the rough tubular brace 74 until the desired requirements of rigidity are achieved. This produces the final brace element 80. Lastly, the tubular brace element 80 is affixed to an instrument in the area needing support.

If desired, a foam core 76 can be placed inside the brace element 80 to either attenuate sound wave travel or dampen the vibrational response of the brace element 80. This is another way to customize the acoustic response of the musical instrument. In addition, the brace element 74 may be curved or co-molded with other brace elements.

For the open tube bracing, such as that which forms the second solitary element brace 28 in FIG. 1, the process may not need the internal bladder inflation method to generate pressure to consolidate the plies. Rather, the prepreg may be positioned between two heated metal molds which are pressed together to apply the consolidation pressure to shape and cure the part.

It will be understood that the embodiments of the present invention assembly and method that have been illustrated are merely exemplary and that a person skilled in the art can make variations to the shown embodiment without departing from the intended scope of the invention. For instance, the tubular bracing can vary widely in shape depending upon the instrument for which it is intended. Furthermore, the number of bracing elements and brace materials can also be varied. All such variations, modifications and alternate embodiments are intended to be included within the scope of the present invention as defined by the claims.

What is claimed is:

1. A string instrument assembly, comprising;

a resonance chamber defined at least in part by a sound board and at least one side wall; and tubular bracing reinforcing at least part of said soundboard within said resonance chamber, wherein said tubular bracing includes at least one tube element that extends between a first end and a second end, each said tube element defining at least one complete interior channel that extends between said first end and said second end wherein each said tube element has a flat side that abuts against said sound board; and side bracing for reinforcing said at least one side wall of said resonance chamber.

2. The assembly according to claim 1, further including at least one relief disposed along said flat side, between said first end and said second end where said tube element is does not abut against said soundboard.

3. The assembly according to claim 1, wherein said tubular bracing has tube walls that define at least part of said at least one interior channel between a first end and a second end.

4. The assembly according to claim 3, wherein said tube walls are metal.

5. The assembly according to claim 3, wherein said tube walls are a composite of fiber material and resin.

6. The assembly according to claim 3, wherein at least one opening is disposed in said tubular walls in at least one point between said first end and said second end.

7. The assembly according to claim 3, wherein said tube walls have a height and thickness.

8. The assembly according to claim 7 wherein said height of said tube walls varies in at least one area between said first end and said second end.

9. The assembly according to claim 7, wherein said thickness of said walls varies in at least one area between said first end and said second end.

10. The assembly according to claim 1, wherein said side bracing is tubular and defines at least one channel that runs through said side bracing from a first end to a second end.

11. The assembly according to claim 10, wherein said at least one side wall of said resonance chamber is curved and said side bracing is curved to match said at least one side wall.

12. In a string instrument having a resonance chamber defined by a soundboard a backboard and at least one side wall, wherein said resonance chamber requires varying degrees of reinforcement in predetermined areas, a method of reinforcing the resonance chamber, comprising the steps of:

providing elements of tubular bracing, each element of tubular bracing having a first end, a second end and at least one flat mounting section disposed between said first end and said second end, wherein each element of tubular bracing defines at least one interior channel;

attaching each said flat mounting section of each element of tubular bracing directly to said soundboard within said resonance chamber, wherein said elements of tubular bracing reinforce said predetermined areas of said soundboard.

13. The method according to claim 12, wherein said step of providing tubular bracing includes the substep of:

forming at least some of said elements of tubular bracing with varying sections of rigidity to match said varying degrees of reinforcement required by said predetermined area of said soundboard.

14. The method according to claim 13, wherein said substep of forming at least some of said elements of tubular bracing with varying sections of rigidity includes varying the shape associated with said tubular bracing along its length.

15. The method according to claim 13, wherein said substep of forming at least some of said elements of tubular bracing with varying sections of rigidity includes cutting openings into said tubular bracing.

16. A string instrument assembly, comprising;

a resonance chamber defined at least in part by opposing sounding surfaces that are both affixed to opposite ends of at least one side wall;

a plurality of hollow tubular bracing elements, each hollow tubular bracing element having a first end, a second end and at least one flat mounting section disposed between said first end and said second end, wherein each flat mounting section is adhered directly to at least one of said sounding surfaces, therein providing reinforcement within said resonance chamber.

17. The assembly according to claim 16, further including side bracing for reinforcing said at least one side wall of said resonance chamber.

18. A string instrument assembly, comprising;

a resonance chamber defined at least in part by a sound board and at least one side wall;

tubular bracing reinforcing at least part of said soundboard within said resonance chamber, wherein said tubular bracing defines at least part of an interior compartment when in abutment with said soundboard; and side bracing for reinforcing said at least one side wall of said resonance chamber wherein said side bracing is tubular and defines at least one channel that runs through said side bracing from a first end to a second end.

* * * * *